United States Patent [19]

Sarantitis

[11] Patent Number: 4,579,489

[45] Date of Patent: Apr. 1, 1986

[54] INTERLOCKING, STACKING AND NESTING CONTAINER SYSTEM

[75] Inventor: Anthony Sarantitis, Pacifica, Calif.

[73] Assignee: Palcon Corporation, San Francisco, Calif.

[21] Appl. No.: 606,031

[22] Filed: May 1, 1984

Related U.S. Application Data

[63] Continuation-in-part of Ser. No. 441,471, Nov. 15, 1982, abandoned.

[51] Int. Cl.[4] ..... B60P 1/64

[52] U.S. Cl. ..... 410/80; 108/56.3; 206/507; 206/509; 206/511

[58] Field of Search ..... 410/80; 206/203, 501, 206/504, 505, 506, 507, 509, 510, 511, 514; 108/53.3, 55.3, 56.3

[56] References Cited

U.S. PATENT DOCUMENTS

| | | | |
|---|---|---|---|
| 1,912,847 | 6/1933 | Klepel | 108/53.1 |
| 1,922,605 | 8/1933 | Spear . | |
| 2,646,186 | 7/1953 | Russell . | |
| 3,125,353 | 3/1964 | Gohmann . | |
| 3,326,410 | 6/1967 | Asenbauer | 206/507 |
| 3,343,706 | 9/1967 | Berend . | |
| 3,346,137 | 10/1967 | Ricci . | |
| 3,383,009 | 5/1968 | Weikert | 206/506 |
| 3,447,715 | 6/1969 | Beney | 206/507 |
| 3,685,463 | 8/1972 | Francis | 108/56.3 |
| 3,719,273 | 3/1973 | Abe . | |
| 3,958,711 | 5/1976 | Morris et al. . | |
| 4,079,077 | 3/1978 | David | 206/507 |
| 4,204,596 | 5/1980 | Davis . | |
| 4,204,617 | 5/1980 | Hirota . | |

FOREIGN PATENT DOCUMENTS 904198 8/1962 United Kingdom .

*Primary Examiner*—Martin P. Schwadron
*Assistant Examiner*—Sheri M. Novack
*Attorney, Agent, or Firm*—Townsend and Townsend

[57] ABSTRACT

A container, which is typically rectangular, includes a bottom and an upwardly extending sidewall. Upper and lower support surfaces, preferably adjacent the sidewall, allow the containers to be stacked. The container has an interlocking member for laterally coupling containers in one vertical column with containers in an adjacent vertical column. The interlocking member extends laterally from the outer surface of the sidewall. The interlocking member includes an upper portion extending a first distance above the upper support surface. The container includes a cavity extending upwardly from the bottom. The cavity is open at the bottom and is sized for insertion of the upper portion of an interlocking member therein. In so doing a container on one level becomes laterally interlocked with a container on a level either above or below it and to one side. Providing upwardly and outwardly tapering sidewalls and vertically offset upper and lower support surfaces permit the containers to be stacked when full or nested when empty.

35 Claims, 14 Drawing Figures

INTERLOCKING, STACKING AND NESTING CONTAINER SYSTEM

This is a continuation-in-part of U.S. patent application Ser. No. 441,471 filed November 15, 1982, now abandoned.

BACKGROUND OF THE INVENTION

Many products are stored in individual containers, the containers then being stacked on one another on a warehouse floor or on pallets. To provide stability for the stack, several things can be done. One common approach is to bind together all the containers stacked on a pallet. This is often done, for example, when the containers are cardboard boxes each containing bottled beverages.

Another method for increasing the stability of a stack of containers is to stagger the containers in adjacent levels similar to the way a mason staggers bricks when building a brick wall. Although the staggered approach produces stacks of containers which are much more stable than stacks having vertical columns of containers, shifting is still possible between the various levels of boxes and between the containers in individual levels. Another drawback with staggered stacks is that they do not readily lend themselves to automatic stacking since the containers in each level are placed in locations different from the adjacent level. Also, the geometry of the containers may not lend itself to this sort of stacking.

A third method used to improve stability is to extend a projection from the top of the container to prevent lateral shifting of the overlying containers. Although this helps to prevent shifting of containers in one horizontal direction, it may not prevent shifting in a transverse direction nor does it interlock one column of containers with another column of containers.

In some situations the containers in which a product or material is shipped are reusable and therefore must be returned. To reduce the inefficiency of transporting a load of empty containers, it is desirable that the containers be collapsible or nesting to reduce the space they occupy. However, the requirement of a container being stackable, interlockable and nestable has not been available.

SUMMARY OF THE INVENTION

The invention relates to a stackable container having interlocking members for laterally coupling containers in one vertical column with containers in an adjacent vertical column. The containers are configured to ensure that the product or material contained by the containers is not damaged when several containers are stacked one on top of the other. A further aspect of the invention permits the stackable, interlocking containers to nest within one another when empty so they take up minimal room.

The container, which is typically rectangular, includes a bottom and upwardly extending sidewalls. The sidewalls have upper edges defining a top, which is usually open. Upper support surfaces, positioned at or near the container top, are positioned to provide vertical support to an overlying container. A generally vertically disposed interlocking member extends laterally outwardly from a sidewall. The interlocking member includes an upper portion which extends upwardly a first distance above the upper surface.

In a first embodiment the interlocking member also includes a lower portion extending a second distance below the upper support surface, which in this first embodiment is defined by the upper edge of the sidewall. The container includes a trough formed into one side of the container. The trough extends from the upper edge of the sidewall downwardly at least the second distance. The trough is sized and positioned so that the lower portion of the interlocking member of another container is housed within the trough when the two containers are placed adjacent one another on the same level. Such placement helps to restrict lateral movement of adjacently placed containers in directions parallel to their abutting sidewalls.

The containers also include a cavity adjacent the sidewall extending at least the first distance above the bottom support surface. The cavity is open at the bottom and is sized for inserting the upwardly extending upper portion of the interlocking member therein. In so doing a container on one level becomes laterally interlocked with a container on a level either above or below it and to one side. Thus the containers in one vertical column become interlocked with the containers in an adjacent vertical column without the need for staggering the containers at each level.

Each container may include an upwardly extending handle and a complementary handle hole formed in its bottom. Engagement of the handle of one container within the handle hole of an overlying container provides lateral interlocking between containers in the same vertical column.

The upper and lower support surfaces allow containers to be stacked without crushing the product or material within the container. The upper support surface is defined in the first embodiment by the upper circumference edge of the sidewalls. The sidewalls are generally vertical so the bottom of one container acts as the lower support surface and rests on the upper circumferential edge of an underlying container. In another embodiment, which is nestable when empty, the sidewall tapers upwardly and outwardly and the upper support surface is defined by a number of individual upper support surfaces overlying the interior of the container; the lower support surface is also defined by a number of individual lower support surfaces. The upper and lower support surfaces are sized and positioned so the lower support surfaces rest on the upper support surfaces when in a stacking configuration, but when in a nesting configuration the upper and lower support surfaces are offset to allow the overlying container to nest within the underlying container.

Another aspect of the invention is the use of a specially configured base for use with the containers. The base includes a number of risers. The risers are formed for engagement into the handle holes of the containers. One embodiment of the base also has downwardly projecting lugs positioned to support the base above the floor so that the base and containers thereon can be moved using a standard forklift. The base can also be supported by a wheeled frame to facilitate movement of the base and containers. The base is secured to the frame typically using mounting pins placed to engage mounting holes formed within the lugs on the base. Coupling the base to the wheeled frame creates a movable cart for the containers. The base can have one or more upwardly extending sides if desired. Such a base may be made of molded plastic reinforced with spring steel for long life and economy. The base may also include wheel engaging openings sized and positioned to engage the wheels of an overlying wheeled cart. This allows several empty carts to be stacked one on top of the other for transport or storage.

A primary feature of the present invention is the provision of the interlocking member and the associated cavity in the container. Since the interlocking member is laterally offset from the container, the containers can be stacked vertically in columns and yet be interlocked with the containers in adjacent columns. Thus the ease and simplicity of stacking containers in columns directly over one another is achieved while providing interlocking between containers in different columns and different levels. This results in an extremely stable container stack. Another key feature of the invention is the provision of the individual upper and lower support surfaces, which permit the containers to be either stacked or nested, while retaining the interlocking features provided by the interlocking member and associated cavity.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
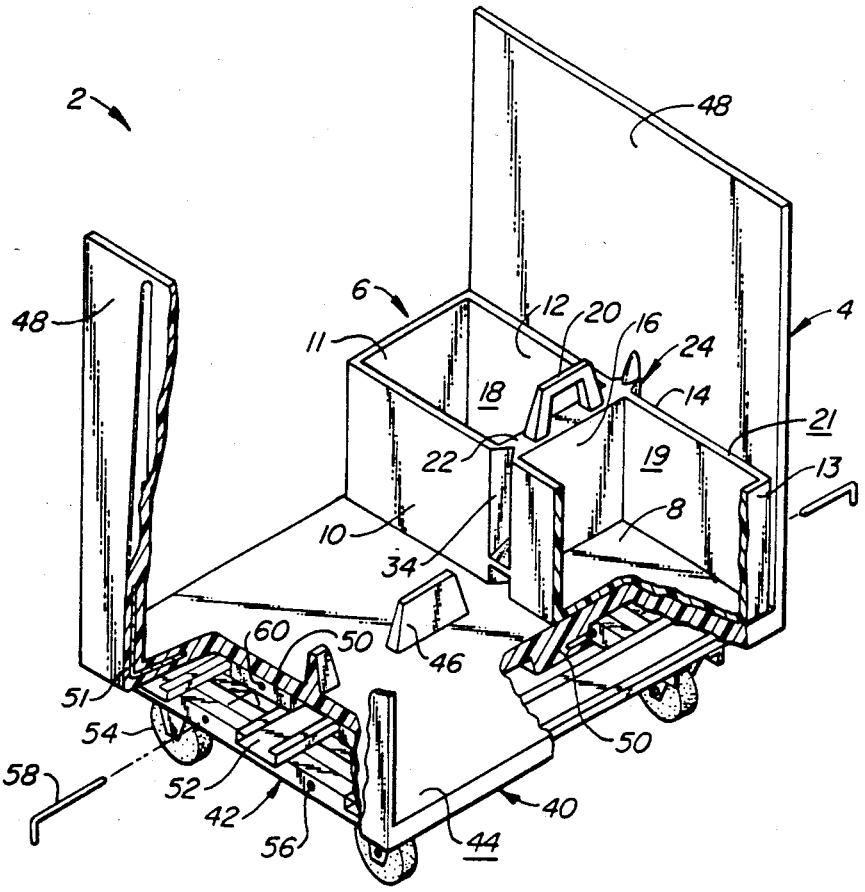
FIG. 1 is an isometric view showing a container loaded on a cart made according to the present invention.
Figure 2:
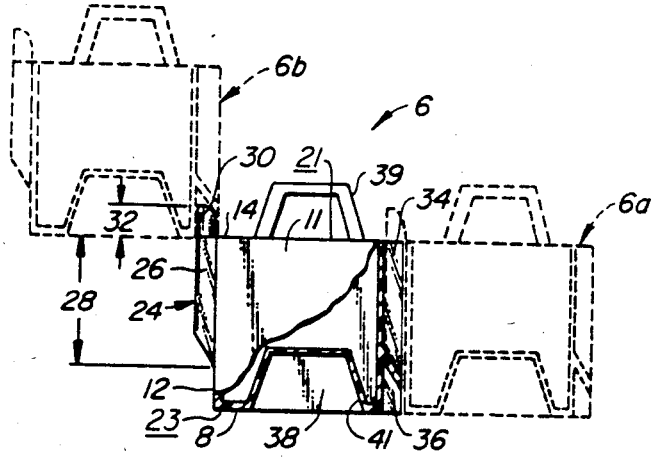
FIG. 2 is a side view of the container of FIG. 1 with portions broken away for clarity and showing adjacent containers in phantom.

Turning now to FIGS. 1 and 2, a first embodiment of the product handling system 2 of the invention includes generally a wheeled cart 4 adapted for carrying one or more containers 6.

Container 6 includes a bottom 8 and upwardly extending sidewalls 10, 11, 12 and 13. The sidewalls terminate at an upper edge 14. A central partition 16 separates the interior of container 6 into two compartments 18, 19. A handle 20 extends upwardly from the upper surface 22 of partition 16. Upper edge 14 and upper surface 22 are generally coplanar. Upper edge 14 and upper surface 22 define an upper support surface 21 upon which portions of bottom 8, defining a lower support surface 23, rest. Although upper and lower support surfaces 21, 23 each define flat planes, they need not do so.

An interlocking member 24 extends laterally from sidewall 12. A lower portion 26 of member 24 extends a second distance 28 below upper support surface 21. An upper portion 30 of member 24 extends a first distance 32 above upper support surface 21. Member 24 allows adjacent containers to be interlocked one with another as shown in FIG. 2. To do so container 6 includes a trough 34 formed in sidewall 10. Trough 34 is sized to accommodate the lower portion 26 of interlocking member 24 of a laterally adjacent container. This relationship is shown by containers 6 and 6*a* in FIG. 2. Vertically beneath trough 34 is a cavity 36 sized for receipt of the upper portion 30 of an interlocking member 26 of another container situated below and laterally adjacent such container. This is illustrated by containers 6 and 6*b* in FIG. 2. Cavity 36 is open at the bottom and extends upwardly at least first distance 32 to accommodate upper portion 30.

Engagement of lower portion 26 within trough 34 restricts relative lateral movement between containers on the same level in directions parallel to sidewalls 10, 12. That is, such engagement restricts relative movement of containers 6 and 6*a* perpendicular to sidewalls 11, 13. Engagement of upper portions 30 within cavity 36 provides interlocking between containers in adjacent columns and on adjacent levels. Thus, container 6 is interlocked with container 6*b* so that relative movement between them in directions parallel to bottom 8 is restricted.

A further interlocking function is achieved through the engagement of handle 20 within a handle hole 38 formed in bottom 8 of container 6. This engagement restricts relative lateral movement of one container relative to a container directly above or below. Handle 20 and handle hole 38 have tapered sides 39, 41 to help guide a container into proper position on top of the underlying container.

Referring again to FIG. 1, cart 4 is seen to include a base 40 and a wheeled frame 42. Base 40 includes a planar surface 44, upon which container 6 rests, and a number of upwardly extending risers 46 placed to engage the handle holes 38 of containers 6. Provision of risers 46 keeps containers 6 from shifting on surface 44. Base 40 also includes a pair of upwardly extending sides 48 and four depending lugs 50. Lugs 50 are sized and positioned so that when base 40 is resting on a flat surface, a forklift can be used to move it about. Base 4 can be made of plastic reinforced by spring steel members 51 for strength.

Wheeled frame 42 includes a framework 52 and four depending steerable castor wheels 54. Framework 52 includes a number of holes 56 through which pins 58 pass. Holes 56 are positioned for alignment with complementary holes 60 formed in lugs 50. Base 40 is removably secured to wheeled frame 42 using pins 58 engaging holes 56 and 60.

In use, containers 6, filled with an appropriate product or material, are loaded onto cart 4 one layer at a time. After each layer is placed, the next layer is loaded on the cart placing each container directly on top of the underlying container. Proper placement is aided by the engagement of handles 20 within handle holes 38, which also provides lateral interlocking between containers in a single column. Engagement of lower portions 26 within troughs 34 restricts lateral movement between containers in a single level in a direction perpendicular to sides 11, 13. Engagement of the upper portions 30 of interlocking members 24 within cavities 36 provides lateral interlocking between containers at one level and in one column and containers in an adjacent level and column.

Figure 3:
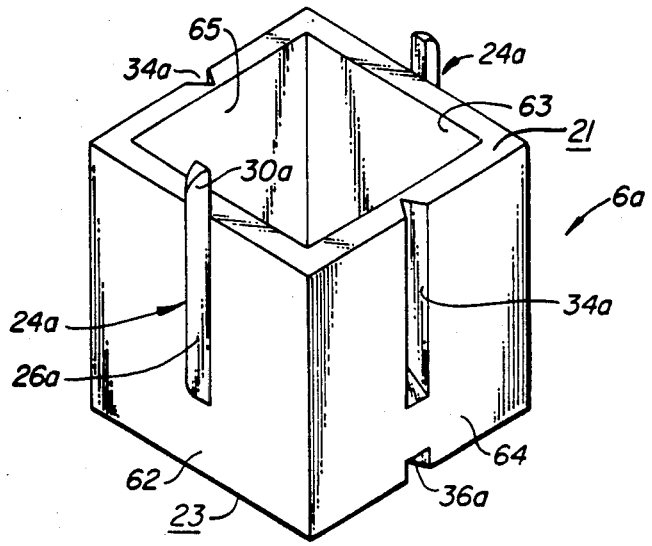
FIG. 3 is an isometric view of an alternative embodiment of the container of FIG. 1.

An alternative embodiment of container 6 is shown in FIG. 3. It is similar to container 6 but is square, has no center partition and has no handle. Container 6*a* includes a pair of interlocking members 24*a* extending from sides 62, 63, a pair of troughs 34*a* formed within sides 64, 65 and a pair of cavities 36*a* formed adjacent sides 64, 65 and below troughs 34*a*.

Figure 4:
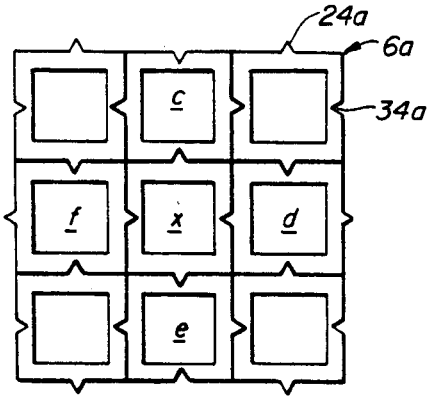
FIG. 4 is a schematic plan view of a layer of the containers of FIG. 3.

FIG. 4 is a schematic plan view showing a number of rows of interlocked containers 6*a* all on the same level. Containers indicated by the reference letters c, d, e and f surrounding container x are all interlocked with container x against movement parallel to their abutting sides. In addition the upper portions 30*a* of interlocking members 24*a* of the container x are interlocked with the containers (not shown) overlying (on top of) containers c and e through the engagement of upper portions 30*a* of container x with the cavities 36*a* of such overlying containers. In addition, containers (not shown) underlying (beneath) containers d and f are interlocked with container x through the engagement of such underlying containers' upper portions 30*a* of their interlocking members 24*a* with cavities 36*a* of container x.

Thus in the configuration of FIGS. 3 and 4 interlocking is achieved among containers on the same level, and among containers on underlying and overlying levels in adjacent columns. An extremely stable three-dimensional stacking arrangement is thus achieved.

Figure 5:
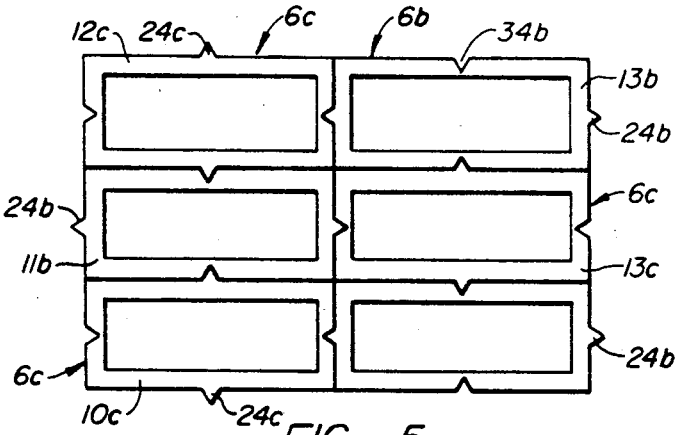
FIG. 5 is a schematic plan view of a layer of a third embodiment of containers.

In FIG. 5 a third embodiment of the container of the invention is disclosed. In this embodiment the container has an elongate rectangular cross-sectional shape similar to the container of FIG. 1. However, to allow three dimensional interlocking as is achieved with the container disclosed in FIG. 3, two versions of the container are used. In one version, labeled container 6*b*, interlocking members 24*b* are on the short sides 11*b* and 13*b* while on container 6*c* interlocking members 24*c* are on long sides 10*c* and 12*c*. Although the interlocking achieved with containers 6*b* and 6*c* is similar to that achieved with container 6*a*, two different version of the same container are used to do so.

Figure 6:
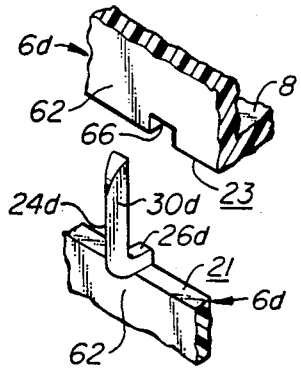
FIG. 6 shows an alternative embodiment of the interlocking member of FIG. 3.

Referring now to FIG. 6, an alternative embodiment of interlocking member 24*d* is shown extending from the upper support surface 21 of a side 62 of the container of FIG. 3. Interlocking member 24*d* is generally L-shaped having an upper portion 30*d* at a position corresponding to portion 30*a* of the embodiment of FIG. 3. However, the lower portion 26*d* overlies surface 21. To accommodate this, container 6*d* has a notch 66 formed in its lower surface 23 below interlocking member 24*d*. The engagement of lower portion 26*d* within notch 66 provides lateral stability for the overlying container 6*b*. Other interlocking schemes may be used as well. For example, a container may include interlocking members on adjacent sides and mating cavities on the opposite sides. Also, more than one interlocking member may be used on a side.

Figure 7:
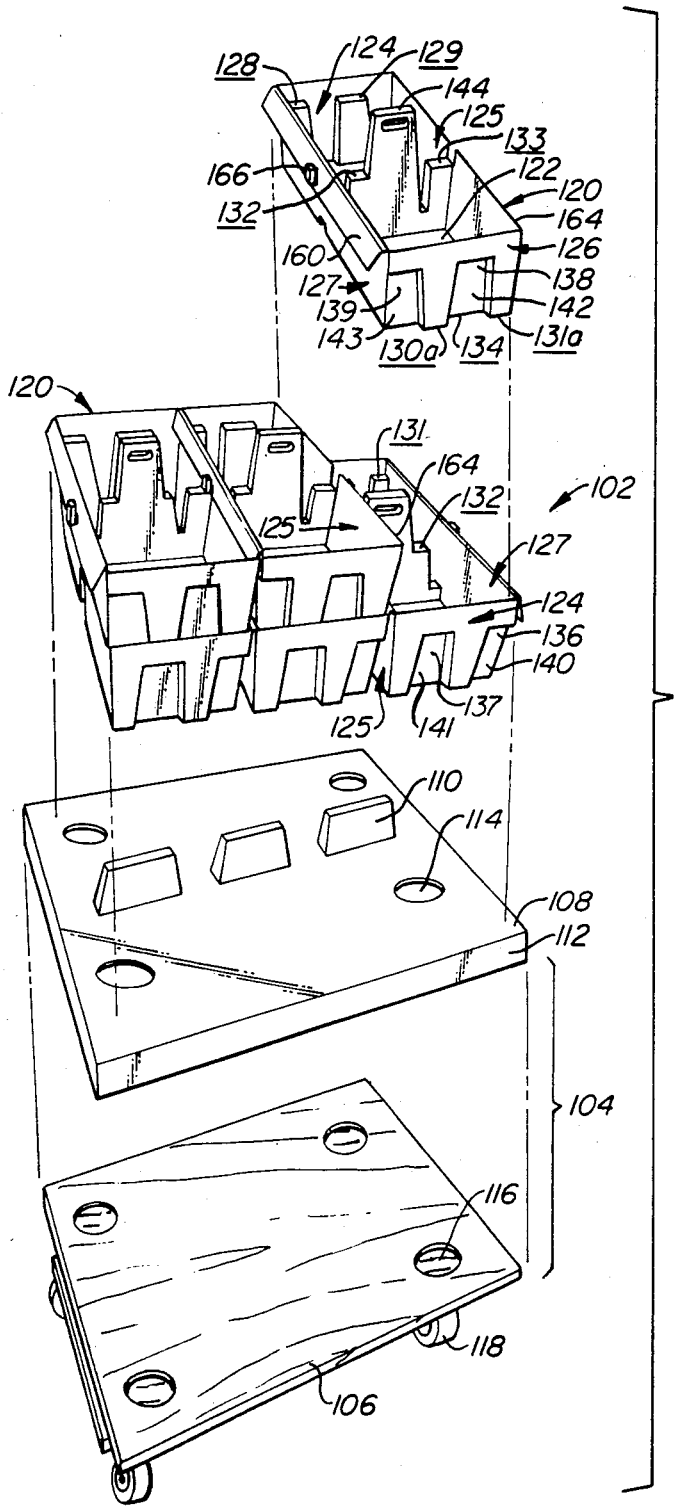
FIG. 7 is an exploded perspective view of a fourth embodiment of containers made according to the invention, the containers being stackable and interlocking and also being nestable, and a second cart embodiment.
Figure 8A:
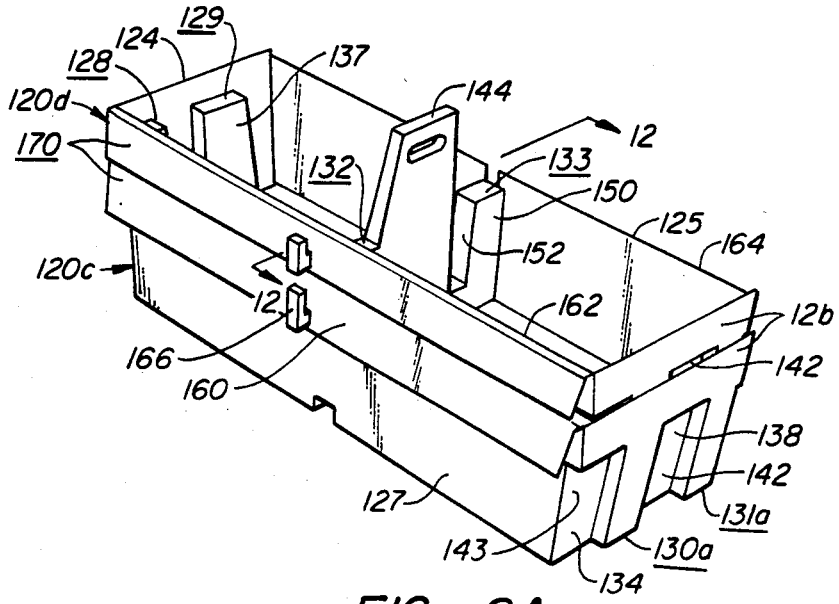
FIGS. 8A and 8B are perspective views showing two containers of FIG. 7 in nested and stacked configurations respectively.
Figure 8B:
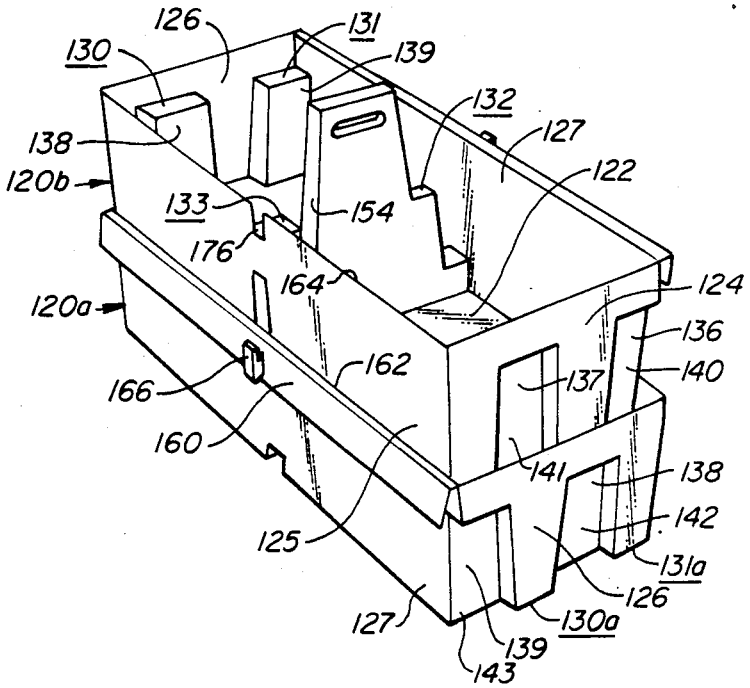

Referring to FIGS. 7, 8A and 8B, a further alternative embodiment of system 2 of FIG. 1 is shown. Product handling system 102 is shown to include generally a wheeled cart 104 including a wheeled base 106 upon which a base cover 108 is removably mounted. Base cover 108 includes a number of upstanding risers 110, a downwardly extending lip 112 and a number of wheel openings 114 positioned to overlie the blind holes 116 formed in base 106. Openings 114 and holes 116 are sized and positioned to accommodate the wheels 118 of an overlying cart to permit the carts, when empty, to be stacked one upon the other during transport or storage. This feature is described in more detail in U.S. patent application Ser. No. 546,673 filed Oct. 28, 1983 for Stacking Cart and Cover, the disclosure of which is incorporated by reference.

System 102 also includes a number of interlocking containers 120 which are both stackable and nestable. Containers 120 include a bottom 122 and four upwardly and outwardly tapering sides 124, 125, 126 and 127, also known as first, second, third and fourth sides respectively. Tapering sides 124–127 help to enable containers 120 to nest, as shown in FIG. 8A.

Figure 9A:
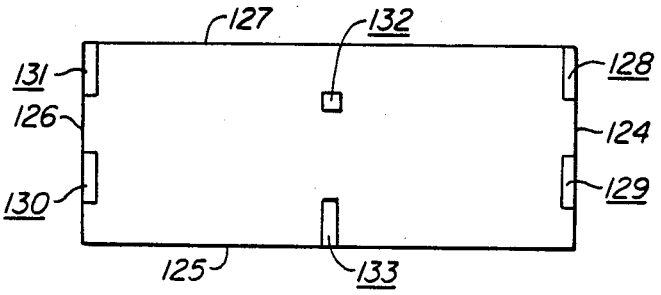
FIGS. 9A and 9B are schematic top and bottom views of the container of FIG. 7 showing the upper and lower support surfaces.
Figure 9B:
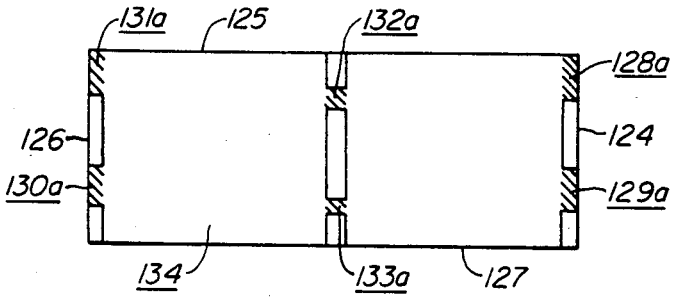

Containers 120 also include six individual upper support surfaces 128–133 and six individual lower support surfaces 128*a*–133*a*. These support surfaces are best illustrated in FIGS. 9A and 9B. Lower support surfaces 128*a*–133*a* are portions of the lower surface 134 of the bottom 122 of container 120. These surface areas are cross-hatched in FIG. 9B to so indicate. Upper and lower support surfaces 128–133 and 128*a*–133*a* are sized and positioned so that lower surfaces 128*a*–133*a* overlie and rest upon corresponding upper support surfaces 128–133 of an underlying container 120 when in the stacked configuration of FIG. 7 and 8B, that is when container 120*a* is rotated 180° about a vertical axis relative to container 120*b*.

Sidewalls 124 and 126 have inwardly extending portions 136, 137, 138 and 139 which define support surfaces 128–131 at their upper ends. Portions 136–139 taper inwardly from bottom 122 to their respective support surfaces 128–131. Portions 136–139 are hollow to define corresponding wall openings 140, 141, 142 and 143. The combination of the upwardly tapering configuration of portions 136–139 plus the provision of hollow regions 140–143 allow containers 120 to nest within one another when aligned in the nesting configuration of FIG. 8A. That is, portions 136–139 of a lower container 120*c* fit within regions 140–143 of an upper container 120*d* as shown in FIG. 8A.

Figure 10:
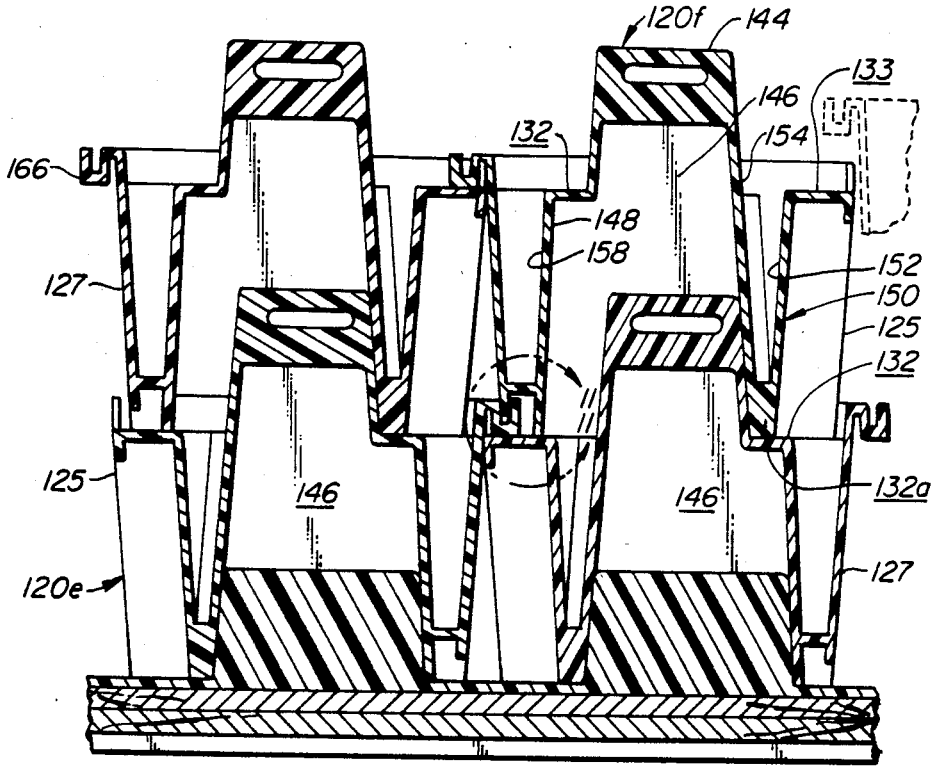
FIG. 10 is a cross-sectional view showing two rows of containers of FIG. 7 mounted to the cart of FIG. 7 with the containers in the stacked configuration of FIG. 8A.
Figure 12:
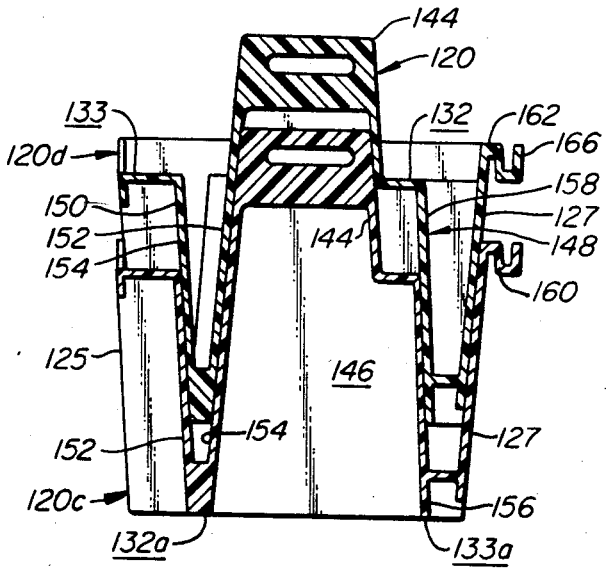
FIG. 12 is a cross-sectional view of nesting containers taken along line 12—12 of FIG. 8A.

Containers 120 also include a handle 144 which extends upwardly above upper support surfaces 128–133. Handle 144, as shown in FIGS. 10 and 12, includes a handle hole 146 extending upwardly from lower surface 134 of bottom 122. Handle hole 146 allows the handle of an underlying container to fit therein when the containers are either in the stacked configuration of FIGS. 8B and 10 or the nested configuration of FIGS. 8A and 12.

Upper support surface 132 is formed by a hollow lateral extension 148 of handle 144. Sidewall 125 includes a hollow inwardly extending portion 150 having upper support surface 133 at its upper end.

Figure 11:
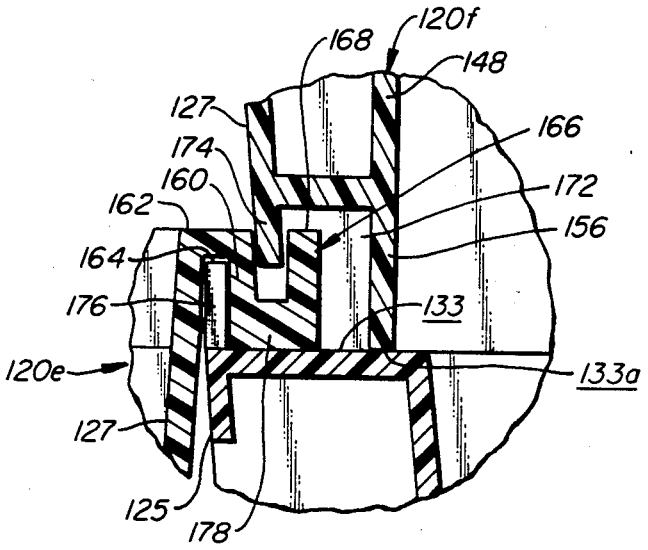
FIG. 11 is an enlarged view taken along line 11—11 in FIG. 10.

Referring to FIGS. 10, 11 and 12, lower support surface 132*a* is formed along lower surface 134 of bottom 122 at the intersection of the opposed sides 152, 154 of inwardly extending portion 150 and handle 144. Lower support surface 133*a* is formed by a lower extension 156 of a side 158 of hollow lateral extension 148.

The engagement of surfaces 132, 132*a* and 133, 133*a* when containers 120 are in their stacked configuration as shown in FIGS. 10 and 11. The nested configuration of FIG. 8A is shown in FIG. 12 with sides 152, 154 of the overlying container 120 fitting between the corresponding sides of the underlying container. Likewise, sides 158 and 127 fit between the corresponding sides of the underlying container as well.

Containers 120 include an outwardly and downwardly tapering lip 160 along the upper edge 162 of side 127. Lip 160 is sized to fit over the upper edge 164 of side 125 as shown in FIGS. 7 and 10. This helps interlock containers 120 lying in the same row.

An interlocking member 166 having an upwardly extending portion 168 extends laterally outwardly from the outer surface 170 of lip 160. Upwardly extending portion 168 of interlocking member 166 serves the same purpose as upper portion 30 of interlocking member 24. That is, when containers 120 are in the stacked configuration of FIG. 7, 8B, 10 and 11, member 166 of a container 120*e* (see FIGS. 10 and 11) engages a cavity 172 formed along side 127 of a container 120*f*, container 120*f* being above and to one side of container 120*e*. Cavity 172 (see FIG. 11) is defined between an interlocking member engaging member 174 and lower extension 156 of side 158.

The upper portions 30, FIG. 2, 168, FIG. 11, of interlocking members 24, 166 engage cavities 36, 172 defined by a portion of the sidewalls 10, 127. However, other types of structures may be used to engage the interlocking members of an underlying and vertically offset container.

A slot 176 is formed in side 125 adjacent upper edge 164 and extends downwardly to upper support surface 133. Slot 176 is provided to allow the narrowed laterally extending portion 178 of interlocking member 166 to fit within slot 176. This feature can be useful if it is desired not to extend lip 160 into the interior of the laterally adjacent container. Also, if lip 160 is eliminated and interlocking member 166 is mounted directly to side 127, narrowed portion 178 of member 166 can be positioned within slot 176 so that portion 168 lies above the interior of the adjacent container 120.

In use of the embodiment of FIG. 7, containers 120 are filled with a product or material and a first row is placed onto cart 104 with handle holes 146 engaged over risers 110. The first row of containers 120 are placed down right to left in FIG. 7 to allow lips 160 to engage over edges 164. The second row of containers 120 are rotated 180° about a vertical axis relative to the containers in the first row (so to be in the stacking orientation) and stacked on top of the first row left to right. In doing so containers 120 in one horizontal row engage containers in underlying and overlying rows and offset by one vertical column through the engagement of members 166 within cavities 172. Relative lateral shifting between containers in the same column is restricted through the engagement of handles 144 within handle holes 146 and the fact that bottoms 122 are surrounded by sides 124–127. Relative lateral shifting between containers in the same row is inhibited by the engagement of lips 160 over edges 164.

Several empty carts 104 can be stacked one upon the other with wheels 118 of one cart 104 engaging the wheel openings 114 and blind holes 116 of the underlying cart 104. Empty containers 120 are nested in their common nesting orientation. Such nested containers can either be separate vertical columns of containers or laterally interlocked columns of containers wherein the containers 120 are nested one row at a time. Doing so permits engagement of lips 160 over edges 164 and interlocking member 166 within the interior of the laterally adjacent container 120 to provide interlocking between the columns of containers.

Other modification and variation can be made to the disclosed embodiments without departing from the subject of the invention as defined in the following claims. For example, container 6 may be made a shape other than rectangular, such as hexagonal.

I claim:

1. An interlocking, stackable product container comprising:

a bottom;

a sidewall, extending upwardly from the bottom and terminating at an upper edge;

an interlocking member projecting laterally from said sidewall near the upper edge, said interlocking member including an upwardly projecting part projecting upwardly a first distance; and means for engaging the upwardly projecting part of the interlocking member of an offset and underlying container;

whereby a first column of said containers stacked one upon another are interlocked with a second adjacent column of said containers through the engagement of the upwardly projecting part of an interlocking member of one container in the first column with the engaging means of another container in the second column.

2. The container of claim 1 wherein said upwardly projecting part extends above said upper edge.

3. The container of claim 1 wherein:

said interlocking member includes a lower part extending a second distance below said upper edge along said sidewall; and said sidewall has a trough formed therein and extending at least said second distance below said upper edge, said trough positioned and configured for receipt of the lower part of an interlocking member of a laterally adjacent container.

4. The container of claim 1 wherein said engaging means includes a portion of said sidewall defining a cavity within which said upwardly projecting part engages.

5. The container of claim 1 further comprising:

projection means, extending upwardly directly above said container, for interlocking said container with a directly overlying container; and aperture means in said bottom for receipt of said projection means, whereby containers stacked in a single column are restrained from relative lateral movement.

6. The container of claim 5 wherein said projection means includes an upwardly extending handle.

7. A product handling system comprising:

a plurality of interlocking stackable product containers comprising:

a bottom;

a sidewall, extending upwardly from the bottom and terminating at an upper edge;

an interlocking member projecting laterally from said sidewall near the upper edge, said interlocking member including an upwardly projecting part projecting upwardly a first distance; and means for engaging the upwardly projecting part of the interlocking member of an offset and underlying container;

whereby a first column of said containers stacked one upon another are interlocked with a second adjacent column of said containers through the engagement of said upwardly projecting part of an interlocking member of one container in the first column with said engaging means of another container in the second column; and a base adapted for supporting a plurality of said containers.

8. The product handling system of claim 7 wherein said base includes means for restricting lateral movement of said containers resting on said base.

9. The product handling system of claim 7 wherein:

said containers include an upwardly extending handle;

said containers have an upwardly extending handle hole means in said bottom for receiving the handle of a directly underlying container; and said base includes at least one riser configured for mating engagement within said hole means of a container resting on said base.

10. The product handling system of claim 7 further comprising wheel means for movably supporting said base.

11. The product handling system of claim 10 wherein said wheel means includes a frame having depending wheels.

12. The product handling system of claim 11 further comprising means for releasably coupling said frame to said base.

13. The product handling system of claim 12 wherein said releasably coupling means includes a removable pin means mounted to said frame and said base has a mounting hole, said pin means configured and positioned for mating engagement within said mounting hole.

14. The product handling system of claim 7 wherein said base includes at least two upwardly extending sidewalls.

15. The product handling system of claim 14 wherein said base is constructed of steel reinforced plastic.

16. The product handling system of claim 10 wherein said base has an upper surface, said base including a plurality of wheel positioners on said upper surface located to engage the wheels of an overlying base.

17. The product handling system of claim 9 wherein said base includes depending wheels, a lower base portion and a removable upper base portion, said riser being a part of said upper base portion, said base having a plurality of wheel positioners located to engage the wheels of an overlying base.

18. The product handling system of claim 17 wherein said wheel positioners comprise openings formed through said upper base portion and at least partially into said lower base portion.

19. A stacking and nesting container comprising:

a bottom;

an upwardly and outwardly tapering sidewall extending upwardly from said bottom and terminating at a circumferential edge defining an open top;

an interlocking member projecting laterally outwardly from said sidewall, said interlocking member including an upwardly projecting part near said circumferential edge;

means, adjacent said sidewall near said bottom, for engaging said upwardly projecting part of a laterally offset and underlying container; and upper and lower support surfaces generally adjacent said sidewall, said lower support surfaces positioned near the bottom and said upper support surfaces positioned near the circumferential edge, said upper and lower support surfaces being vertically offset from one another;

said upper and lower support surfaces arranged and adapted to support one container on top of another underlying container when in a stacking orientation with the lower support surfaces of the one container resting on the upper support surfaces of the underlying container, and to nest the one container within the underlying container when the containers are in a nesting orientation with the lower support surfaces being vertically offset from the upper support surfaces.

20. The container of claim 19 wherein said sidewall includes first, second, third and fourth sides, said first and third sides opposite one another and said second and fourth sides opposite one another.

21. The container of claim 20 wherein said first and third sides each have an upper and a lower support surface positioned adjacent thereto.

22. The container of claim 20 wherein said first and third sides each have at least two said upper and lower support surfaces adjacent thereto.

23. The container of claim 19 wherein said first and third sides each include said upper support surfaces positioned directly opposite on another.

24. The container of claim 19 further comprising an upwardly extending, centrally positioned handle.

25. The container of claim 24 wherein said handle extends upwardly from said bottom.

26. The container of claim 24 wherein said handle extends above said circumferential edge and said bottom includes a handle hole formed within the handle to accommodate the handle of an underlying container when in either the stacking or nesting orientations.

27. The container of claim 24 further comprising a first upper support surface adjacent said second side and a first lower support surface adjacent said fourth side, said first upper and lower support surfaces and said handle being generally aligned.

28. The container of claim 27 further comprising:

a second lower support surface horizontally positioned between the first upper support surface and said handle and being vertically offset from both; and a second upper support surface horizontally positioned between said handle and the first lower support surface and being vertically offset from both.

29. The container of claim 28 wherein said first and second lower support surfaces are coplanar with the lower surface of the bottom.

30. The container of claim 19 wherein said lower support surfaces are coplanar with the lower surface of the bottom.

31. The container of claim 19 wherein said upper surfaces are coplanar and are below at least a portion of the circumferential edge.

32. The container of claim 20 further comprising a downwardly and outwardly extending lip extending from at least one of said sides along said circumferential edge, said lip sized and positioned to engage a portion of the circumferential edge of another, laterally adjacent container to provide lateral interlock therebetween.

33. An interlocking, nesting and stacking container comprising:

a bottom;

an upwardly and outwardly tapering sidewall extending upwardly from said bottom and terminating at a circumferential edge defining an open top;

upper and lower support surfaces generally adjacent said sidewall, said lower support surfaces positioned near the bottom and said upper support surfaces positioned near the circumferential edge, said upper and lower support surfaces being vertically offset from one another;

said upper and lower support surfaces arranged and adapted to support one container on top of another underlying container when in a stacking orientation with the lower support surfaces of the one container resting on the upper support surfaces of the underlying container, and to nest the one container within the underlying container when the containers are in a nesting orientation with the lower support surfaces being vertically offset from the upper support surfaces;

a handle extending upwardly from a central portion of the bottom, said handle extending above said upper support surfaces, said handle including an upwardly extending handle hole formed therein to accommodate the handle of an underlying container when in either the stacking or the nesting orientations;

an interlocking member projecting laterally outwardly from said sidewall, said interlocking member including an upwardly projecting part extending above at least one of the upper support surfaces; and means, adjacent said sidewall near said bottom, for engaging said upwardly projecting part of a laterally offset and underlying container.

34. A stacking and nesting container comprising:

a bottom;

an upwardly and outwardly tapering sidewall extending upwardly from said bottom and terminating at a circumferential edge defining an open top, said sidewall including first, second, third and fourth sides being opposite one another;

an upwardly extending, centrally positioned handle;

a first upper support surface adjacent said second side and a first lower support surface adjacent said fourth side, said first upper and lower support surfaces and said handle being generally aligned;

a second lower support surface horizontally positioned between the first upper surface and said handle and being vertically offset from both;

a second upper support surface horizontally positioned between said handle and the first lower support surface and being vertically offset from both;

said first and second lower support surfaces positioned near the bottom and said first and second upper support surfaces positioned near the circumferential edge;

said first and second upper and lower support surfaces arranged and adapted to support one container on top of another underlying container when in a stacking orientation with the lower support surfaces of the one container resting on the upper support surfaces of the underlying container, and to nest the one container within the underlying container when the containers are in a nesting orientation with the lower support surfaces being vertically offset from the upper support surfaces.

35. The container of claim 34 wherein said first and second lower support surfaces are coplanar with a lower surface of the bottom.

* * * * *